US006132781A

United States Patent [19]

Carr et al.

[11] Patent Number: 6,132,781

[45] Date of Patent: Oct. 17, 2000

[54] MODIFIED ATMOSPHERE PACKAGE WITH ACCELERATED REDUCTION OF OXYGEN LEVEL IN MEAT COMPARTMENT

[75] Inventors: Daniel G. Carr, Rochester; Glenn C. Castner, Victor; Gary R. DelDuca, Canandaigua; Rollie H. DeMay, Newark; Alan E. Deyo, Rushville; Stephen L. Goulette, Newark; Darryl P. Hansen, Shortsville; Vinod K. Luthra, Pittsford; Allen J. Norby, Fairport; Robert A. Sloan, Palmyra; Jill F. Thompson, Fairport, all of N.Y.

[73] Assignee: Pactiv Corporation, Lake Forest, Ill.

[21] Appl. No.: 09/466,618

[22] Filed: Dec. 17, 1999

Related U.S. Application Data

[62] Division of application No. 09/054,907, Apr. 3, 1998, Pat. No. 6,054,153.

[51] Int. Cl.[7] ..... A23B 4/00

[52] U.S. Cl. ..... 426/124; 426/129; 426/133

[58] Field of Search ..... 206/213.1, 557; 53/432–434, 510; 252/188.28; 426/124, 129, 133, 392, 396, 397, 410, 418

[56] References Cited

U.S. PATENT DOCUMENTS

| | | |
|---|---|---|
| 1,475,396 | 11/1923 | Kestner . |
| 1,679,543 | 8/1928 | Rector . |
| 2,732,092 | 1/1956 | Lawrence . |
| 2,825,651 | 3/1958 | Loo et al. . |
| 3,083,861 | 4/1963 | Amberg et al. . |
| 3,363,395 | 1/1968 | King . |
| 3,419,400 | 12/1968 | Hayhurst et al. . |
| 3,467,244 | 9/1969 | Mahaffy et al. . |
| 3,481,100 | 12/1969 | Bergstrom . |
| 3,545,163 | 12/1970 | Mahaffy et al. . |
| 3,574,642 | 4/1971 | Weinke . |
| 3,587,839 | 6/1971 | Von Brecht et al. . |

(List continued on next page.)

FOREIGN PATENT DOCUMENTS

| | | |
|---|---|---|
| 0 457 457 A2 | 11/1991 | European Pat. Off. . |
| 0 468 880 A1 | 1/1992 | European Pat. Off. . |
| 0 547 761 A1 | 6/1993 | European Pat. Off. . |
| 6-278 774 | 10/1994 | Japan . |
| 6-343 815 | 12/1994 | Japan . |
| 1 556 853 | 11/1979 | United Kingdom . |

OTHER PUBLICATIONS

Gill, "Extending the Storage Life of Raw Chilled Meats," Agriculture and Agri–Food Canada Research Centre., date unknown.

Gill et al., "The Use of Oxygen Scavengers to Prevent the Transient Discoloration of Ground Beef Packaged Under Controlled, Oxygen–depleted Atmospheres," *Meat Science* 41(1):19–27 (1995).

Labell, "Controlled & Modified Atmosphere Packaging, Methods for Extending Shelf Life of a Variety of Food Products," *Food Processing*, Jan. (1985) pp. 152–154.

Ledward, "Metmyoglobin Formation in Beef Stored in Carbon Dioxide Enriched and Oxygen Depleted Atmospheres," *Journal of Food Science* 35:33–37 (1970).

(List continued on next page.)

*Primary Examiner*—Joseph W. Drodge
*Attorney, Agent, or Firm*—Jenkens & Gilchrist

[57] ABSTRACT

A modified atmosphere package includes first and second compartments separated by a partition member that is substantially permeable to oxygen. The first compartment contains an oxygen scavenger activated with an oxygen scavenger accelerator. The second compartment contains a retail cut of raw meat. Various techniques are employed to rapidly reduce the oxygen level in the second compartment below pigment sensitive levels so that the growth of metmyoglobin is inhibited. Some of these techniques increase the flow of oxygen from the second compartment to the first compartment through the partition member, while other techniques directly absorb oxygen within the second compartment by locating a second oxygen scavenger within the second compartment.

4 Claims, 10 Drawing Sheets

U.S. PATENT DOCUMENTS

| | | |
|---|---|---|
| 3,634,993 | 1/1972 | Pasco et al. . |
| 3,650,775 | 3/1972 | Simon et al. . |
| 3,679,093 | 7/1972 | Chang . |
| 3,686,822 | 8/1972 | Wolfelsperger . |
| 3,750,362 | 8/1973 | Kishpaugh et al. . |
| 3,788,369 | 1/1974 | Killinger . |
| 3,792,181 | 2/1974 | Mahaffy et al. . |
| 3,843,806 | 10/1974 | Kishpaugh et al. . |
| 3,851,441 | 12/1974 | Marchand . |
| 3,903,309 | 9/1975 | Mahaffy et al. . |
| 4,083,372 | 4/1978 | Boden . |
| 4,127,503 | 11/1978 | Yoshikawa et al. . |
| 4,141,487 | 2/1979 | Faust et al. . |
| 4,166,807 | 9/1979 | Komatsu et al. . |
| 4,192,773 | 3/1980 | Yoshikawa et al. . |
| 4,201,030 | 5/1980 | Mahaffy et al. . |
| 4,230,595 | 10/1980 | Yamaji et al. . |
| 4,242,659 | 12/1980 | Baxter et al. . |
| 4,299,719 | 11/1981 | Aoki et al. . |
| 4,308,711 | 1/1982 | Mahaffy et al. . |
| 4,317,742 | 3/1982 | Yamaji et al. . |
| 4,332,845 | 6/1982 | Nawata et al. . |
| 4,337,276 | 6/1982 | Nakamura et al. . |
| 4,340,138 | 7/1982 | Bernhardt . |
| 4,349,999 | 9/1982 | Mahaffy et al. . |
| 4,366,179 | 12/1982 | Nawata et al. . |
| 4,384,972 | 5/1983 | Nakamura et al. . |
| 4,406,813 | 9/1983 | Fujishima et al. . |
| 4,411,122 | 10/1983 | Cornish et al. . |
| 4,411,918 | 10/1983 | Cimino et al. . |
| 4,424,659 | 1/1984 | Perigo et al. . |
| 4,454,945 | 6/1984 | Jabarin et al. . |
| 4,510,162 | 4/1985 | Nezat . |
| 4,517,206 | 5/1985 | Murphy et al. . |
| 4,524,015 | 6/1985 | Takahashi et al. . |
| 4,536,409 | 8/1985 | Farrell et al. . |
| 4,543,770 | 10/1985 | Walter et al. . |
| 4,564,054 | 1/1986 | Gustavsson . |
| 4,574,174 | 3/1986 | McGonigle . |
| 4,579,223 | 4/1986 | Otsuka et al. . |
| 4,581,764 | 4/1986 | Plock et al. . |
| 4,588,561 | 5/1986 | Aswell et al. . |
| 4,593,816 | 6/1986 | Langenbeck . |
| 4,622,229 | 11/1986 | Toshitsugu . |
| 4,622,239 | 11/1986 | Schoenthaler et al. . |
| 4,642,239 | 2/1987 | Ferrar et al. . |
| 4,645,073 | 2/1987 | Homan . |
| 4,657,610 | 4/1987 | Komatsu et al. . |
| 4,661,326 | 4/1987 | Schainholz . |
| 4,683,139 | 7/1987 | Cheng . |
| 4,683,702 | 8/1987 | Vis . |
| 4,685,274 | 8/1987 | Garwood . |
| 4,704,254 | 11/1987 | Nichols . |
| 4,711,741 | 12/1987 | Fujishima et al. . |
| 4,728,504 | 3/1988 | Nichols . |
| 4,737,389 | 4/1988 | Hartsing, Jr. et al. . |
| 4,740,402 | 4/1988 | Maeda et al. . |
| 4,756,436 | 7/1988 | Morita et al. . |
| 4,762,722 | 8/1988 | Izumimoto et al. . |
| 4,765,499 | 8/1988 | von Reis et al. . |
| 4,769,175 | 9/1988 | Inoue . |
| 4,783,321 | 11/1988 | Spence . |
| 4,820,442 | 4/1989 | Motoyama et al. . |
| 4,830,855 | 5/1989 | Stewart . |
| 4,830,863 | 5/1989 | Jones . |
| 4,836,952 | 6/1989 | Nasu et al. . |
| 4,840,271 | 6/1989 | Garwood . |
| 4,842,875 | 6/1989 | Anderson . |
| 4,876,146 | 10/1989 | Isaka et al. . |
| 4,877,664 | 10/1989 | Maeda et al. . |
| 4,897,274 | 1/1990 | Candida et al. . |
| 4,908,151 | 3/1990 | Inoue et al. . |
| 4,910,032 | 3/1990 | Antoon, Jr. . |
| 4,923,703 | 5/1990 | Antoon, Jr. . |
| 4,928,474 | 5/1990 | Schirmer . |
| 4,942,048 | 7/1990 | Nasu et al. . |
| 4,943,440 | 7/1990 | Armstrong . |
| 4,949,847 | 8/1990 | Nagata . |
| 4,952,451 | 8/1990 | Mueller . |
| 4,956,209 | 9/1990 | Isaka et al. . |
| 4,992,410 | 2/1991 | Cullen et al. . |
| 4,996,068 | 2/1991 | Hatakeyama et al. . |
| 5,019,212 | 5/1991 | Morita et al. . |
| 5,021,515 | 6/1991 | Cochran et al. . |
| 5,025,611 | 6/1991 | Garwood . |
| 5,045,331 | 9/1991 | Antoon, Jr. . |
| 5,049,624 | 9/1991 | Adams et al. . |
| 5,064,698 | 11/1991 | Courtright et al. . |
| 5,085,878 | 2/1992 | Hatakeyama et al. . |
| 5,096,724 | 3/1992 | Zenner et al. . |
| 5,101,611 | 4/1992 | Biskup et al. . |
| 5,103,618 | 4/1992 | Garwood . |
| 5,108,649 | 4/1992 | Matsumoto et al. . |
| 5,110,677 | 5/1992 | Barmore et al. . |
| 5,112,674 | 5/1992 | German et al. . |
| 5,115,624 | 5/1992 | Garwood . |
| 5,116,660 | 5/1992 | Komatsu et al. . |
| 5,120,349 | 6/1992 | Stewart et al. . |
| 5,120,585 | 6/1992 | Sutter et al. . |
| 5,124,164 | 6/1992 | Matsumoto et al. . |
| 5,128,060 | 7/1992 | Ueno et al. . |
| 5,129,512 | 7/1992 | Garwood . |
| 5,132,151 | 7/1992 | Graney . |
| 5,135,787 | 8/1992 | Bair . |
| 5,143,763 | 9/1992 | Yamada et al. . |
| 5,143,769 | 9/1992 | Moriya et al. . |
| 5,145,950 | 9/1992 | Funaki et al. . |
| 5,151,331 | 9/1992 | Beeson et al. . |
| 5,153,038 | 10/1992 | Koyama et al. . |
| 5,155,974 | 10/1992 | Garwood . |
| 5,158,537 | 10/1992 | Haak et al. . |
| 5,171,593 | 12/1992 | Doyle . |
| 5,176,849 | 1/1993 | Hwa et al. . |
| 5,176,930 | 1/1993 | Kannankeril et al. . |
| 5,194,315 | 3/1993 | Itoh . |
| 5,202,052 | 4/1993 | Zenner et al. . |
| 5,204,389 | 4/1993 | Hofeldt et al. . |
| 5,207,943 | 5/1993 | Cullen et al. . |
| 5,211,875 | 5/1993 | Speer et al. . |
| 5,223,146 | 6/1993 | Kreh . |
| 5,226,531 | 7/1993 | Garwood . |
| 5,226,735 | 7/1993 | Beliveau . |
| 5,227,411 | 7/1993 | Hofeldt et al. . |
| 5,236,617 | 8/1993 | Ueno et al. . |
| 5,239,016 | 8/1993 | Cochran et al. . |
| 5,241,149 | 8/1993 | Watanabe et al. . |
| 5,242,111 | 9/1993 | Nakoneczny et al. . |
| 5,244,600 | 9/1993 | Cuisia et al. . |
| 5,247,746 | 9/1993 | Johnson et al. . |
| 5,250,310 | 10/1993 | Fujino et al. . |
| 5,254,354 | 10/1993 | Stewart . |
| 5,258,537 | 11/1993 | Takeuchi et al. . |
| 5,262,375 | 11/1993 | McKedy . |
| 5,270,337 | 12/1993 | Graf . |
| 5,284,871 | 2/1994 | Graf . |
| 5,286,407 | 2/1994 | Inoue et al. . |
| 5,288,907 | 2/1994 | Sherwin et al. . |
| 5,290,268 | 3/1994 | Oliver et al. . |
| 5,296,291 | 3/1994 | Mueller . |
| 5,310,497 | 5/1994 | VeSpeer et al. . |
| 5,320,598 | 6/1994 | Haak et al. . |
| 5,323,590 | 6/1994 | Garwood . |

5,332,590 7/1994 McKedy .
5,334,405 8/1994 Gorlich .
5,346,312 9/1994 Mabry et al. .
5,346,644 9/1994 Speer et al. .
5,348,752 9/1994 Gorlich .
5,350,622 9/1994 Speer et al. .
5,364,555 11/1994 Zenner et al. .
5,364,669 11/1994 Sumida et al. .
5,378,428 1/1995 Inoue et al. .
5,384,103 1/1995 Miller .
5,390,475 2/1995 Iwauchi et al. .
5,399,289 3/1995 Speer et al. .
5,409,126 4/1995 DeMars .
5,425,896 6/1995 Speer et al. .
5,443,727 8/1995 Gagnon .
5,445,607 8/1995 Venkateshwaran et al. .
5,491,019 2/1996 Kuo .
5,492,705 2/1996 Porchia et al. .
5,492,742 2/1996 Zenner et al. .
5,498,364 3/1996 Speer et al. .
5,507,379 4/1996 Mazur et al. .
5,510,166 4/1996 Inoue et al. .
5,514,392 5/1996 Garwood .
5,529,833 6/1996 Speer et al. .
5,564,974 10/1996 Mazur et al. .
5,580,573 12/1996 Kydonieus et al. .
5,585,129 12/1996 Geddes et al. .
5,603,413 2/1997 Mitchum, Jr. .
5,608,643 3/1997 Wichter et al. .
5,631,036 5/1997 Davis .
5,638,660 6/1997 Kuo .
5,639,815 6/1997 Cochran et al. .
5,643,625 7/1997 Perry et al. .
5,648,020 7/1997 Speer et al. .
5,660,761 8/1997 Katsumoto et al. .
5,665,822 9/1997 Bitler et al. .
5,667,827 9/1997 Breen et al. .
5,667,863 9/1997 Cullen et al. .
5,672,406 9/1997 Challis et al. .
5,686,126 11/1997 Noel et al. .
5,686,127 11/1997 Stockley, III et al. .
5,698,250 12/1997 DeDuca et al. .
5,700,554 12/1997 Speer et al. .
5,711,978 1/1998 Breen et al. .
5,715,169 2/1998 Noguchi .
5,811,142 9/1998 DelDuca et al. .
5,832,699 11/1998 Zobel .
5,928,560 7/1999 DelDuca et al. .
5,948,457 9/1999 DelDuca et al. .

OTHER PUBLICATIONS

Muller, "Longer Product Shelf Life Using Modified Atmosphere Packaging," *The National Provisioner*, Feb. (1986) pp. 19–22.

Brochure on M–Tek Case–Ready Systems, M–Tek Inc., Elgin, Illinois; date unknown.

MODIFIED ATMOSPHERE PACKAGE WITH ACCELERATED REDUCTION OF OXYGEN LEVEL IN MEAT COMPARTMENT

This is a divisional of application Ser. No 09/054,907, filed Apr. 3, 1998, now U.S. Pat. No. 6,054,153.

FIELD OF THE INVENTION

The present invention relates generally to modified atmosphere packages for storing food such as raw meat. More particularly, the invention relates to a modified atmosphere package having two compartments, one containing meat, separated by, a substantially permeable partition member, and relates to techniques for rapidly reducing the oxygen level in the meat-containing compartment below pigment sensitive levels so that the growth of metmyoglobin is inhibited.

BACKGROUND OF THE INVENTION

Containers have long been employed to store and transfer perishable food prior to presenting the food at a market where it will be purchased by the consumer. After perishable foods, such as meats, fruits, and vegetables, are harvested, they are placed into containers to preserve those foods for as long as possible. Maximizing the time in which the food remains preserved in the containers increases the profitability of all entities in the chain of distribution by minimizing the amount of spoilage.

The environment around which the food is preserved is a critical factor in the preservation process. Not only is maintaining an adequate temperature important, but the molecular and chemical content of the gases surrounding the food is significant as well. By providing an appropriate gas content to the environment surrounding the food, the food can be better preserved when maintained at the proper temperature or even when it is exposed to variations in temperature. This gives the food producer some assurance that after the food leaves his or her control, the food will be in an acceptable condition when it reaches the consumer.

Modified atmosphere packaging systems for one type of food, raw meats, exposes these raw meats to either extremely high levels or extremely low levels of oxygen ($O_2$). Packaging systems which provide extremely low levels of oxygen are generally preferable because it is well known that the fresh quality of meat can be preserved longer under anaerobic conditions than under aerobic conditions. Maintaining low levels of oxygen minimizes the growth and multiplication of aerobic bacteria.

One example of a low-level oxygen system is disclosed in U.S. Pat. No. 5,698,250 to DelDuca et al. ("DelDuca"), which is incorporated herein by reference in its entirety. FIGS. 1 and 2 of DelDuca are reproduced herein as FIGS. 1 and 2. Referring to FIGS. 1 and 2, DelDuca discloses a modified atmosphere package 10 including an outer container 12 composed of a oxygen barrier material and an inner container 14 composed of a material substantially permeable to oxygen. The inner container 14 is preferably comprised of a polystyrene foam tray 16 and a stretch film wrapping 18. The tray 16 contains a retail cut of raw meat 26. An oxygen scavenger 28 is located between the inner container 14 and the outer container 12.

To create a modified atmosphere in the package 10, DelDuca employs the following method. First, the meat 26 is placed within the inner container 14, and the inner container 14 is then sealed. Second, the inner container 14 is inserted into the outer container 12. Third, without using any evacuation, the outer container 12 is flushed with an appropriate mixture of gases, such as 30 percent carbon dioxide and 70 percent nitrogen, to remove most of the oxygen from the outer container 12. Fourth, the outer container 12 is sealed. Fifth, the oxygen scavenger 28 is activated and used to absorb any residual oxygen within the package 10. The DelDuca method relies upon activation of the oxygen scavenger 28 to quickly absorb the residual oxygen.

FIG. 2 identifies four oxygen sources, or zones, that exist within the package 10. Zone I is the oxygen volume between the outer container 12 and the inner container 14; zone II is the oxygen volume within the inner container 14; zone III is the oxygen volume within the cells of the foam tray 16; and zone IV is the oxygen volume within the meat 26, which is believed to be minimal with the exception of ground meats. The oxygen scavenger 28 is located in zone I.

In the above-described DelDuca method, the step of flushing the outer container 14 lowers the level of oxygen within the package 10 to about 0.05 to 5 percent. At such oxygen levels, especially at the lower end of the above range (0.05 to 2 percent), metmyoglobin can form very quickly. Metmyoglobin is a substance that causes meat to change to an undesirable brown color. Metmyoglobin forms very slowly at oxygen levels above 2 percent and below 0.05 percent but very quickly between these oxygen levels. Accordingly, it is important to pass the meat located in zone II through the pigment sensitive oxygen range (0.05 to 2 percent) very quickly, e.g., less than about two hours. Although DelDuca contemplates flushing the inner container 14, existing technology generally will not flush zone II down below the pigment sensitive oxygen range. Therefore, even if the inner container 14 is flushed, the oxygen level in zone II must still be passed quickly through the pigment sensitive oxygen range.

In DelDuca, after the outer container 12 is sealed, oxygen remaining in zone II (within the inner container 14) passes through the substantially, but not 100 percent, permeable material of the inner container 14 and is rapidly absorbed by the activated oxygen scavenger 28 in zone I. The faster the rate of oxygen egress from zone II into zone I, the faster the oxygen level in zone II can be passed quickly through the pigment sensitive oxygen range. The present invention is directed to techniques for improving the rate of oxygen egress from zone II into zone I. In addition, the present invention is directed to techniques for directly absorbing oxygen in zone II before the oxygen passes into zone I.

SUMMARY OF THE INVENTION

In accordance with one embodiment of the present invention, a modified atmosphere package includes first and second compartments separated by a partition member that is substantially permeable to oxygen. The first compartment contains an oxygen scavenger activated with an oxygen scavenger accelerator. The second compartment contains a retail cut of raw meat.

To improve the flow of any oxygen in the second compartment from the second compartment to the first compartment, one or more features can be incorporated in the partition member to improve its permeability. For example, if the partition member is partially comprised of a stretch film wrapping such as polyvinyl chloride (PVC), the stretch film wrapping can be provided with a plurality of holes in the form of relatively large holes, pin holes, or microperforations. If the holes are relatively large holes, e.g., having a diameter ranging from about 0.125 inch to about 0.75 inch, the holes are preferably covered with a label composed of TYVEK® spunbonded olefin or paper to prevent meat juice from leaking out of the second compartment through the holes and to prevent desiccation and contamination of the meat. The label is adhered to the stretch film wrapping in areas around the holes. TYVEK spunbonded olefin is entirely permeable to oxygen, so no additional holes are formed in the TYVEK label. If, however, the label is composed of paper or plastic, which are somewhat impermeable to oxygen, pin holes or microperforations are formed in the label.

Various other features can be incorporated in the partition member to increase its permeability, including a snorkel or straw; embossments; a self-sealing film or coating to allow for the creation of temporary holes in the partition member; a Landec-type film having a permeability that can be controlled by heat, light, or some other energy source; and two layers of perforated stretch film wrapping. If the partition member includes a stretch film wrapping wrapped about a foam tray, a section of the tray wall can be composed of open-cell or perforated foam. This section of the tray wall is left uncovered by the stretch film wrapping to allow oxygen from the second compartment to readily pass through both the stretch film wrapping and through the exposed section of the tray wall.

Other techniques for rapidly reducing the oxygen level in the second compartment pertain less to changing the structure of the partition member. For example, a second oxygen scavenger can be placed inside the second compartment away from the meat, or scavenging material can be dispersed in the tray wall. Alternatively, carbon dioxide pellets can be placed inside the second compartment away from the meat. The pellets serve as a flushing agent that forces oxygen out of the second compartment. Also, the finished package can be irradiated to create ozone ($O_3$) within the package. Ozone is more readily scavenged by the oxygen scavenger.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
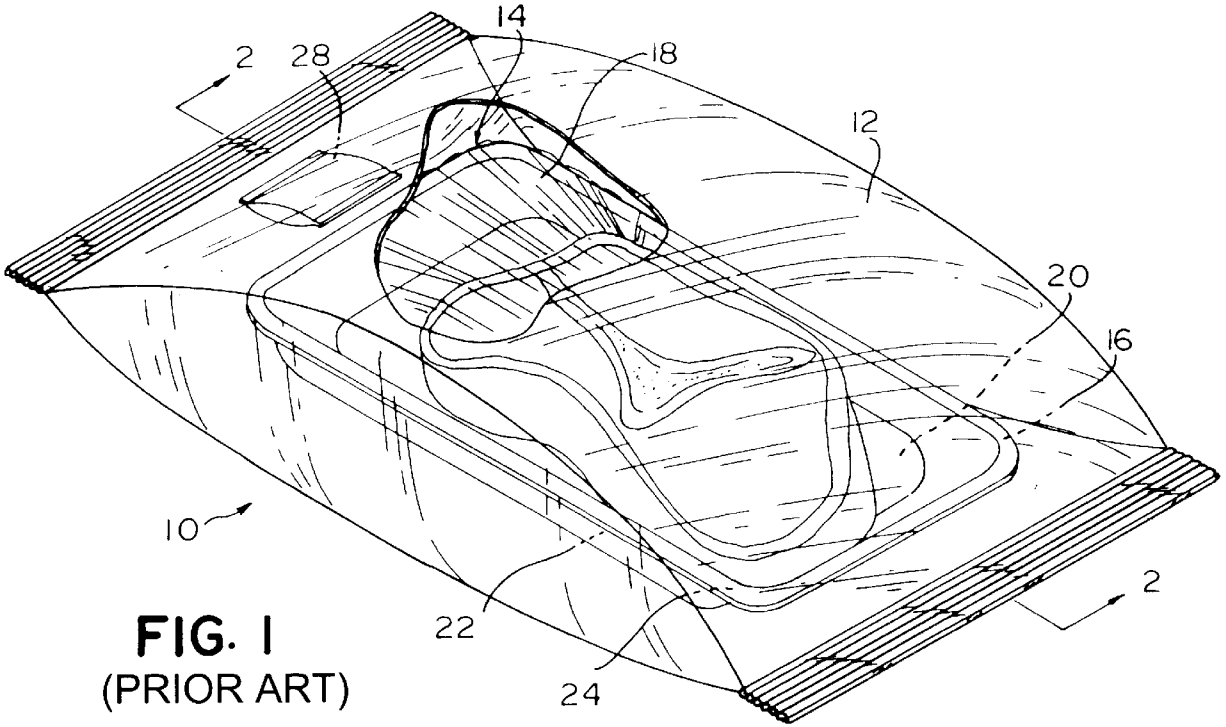
FIG. 1 (PRIOR ART)
FIG. 1 is an isometric view of a modified atmosphere package.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF ILLUSTRATIVE EMBODIMENTS

Figure 2:
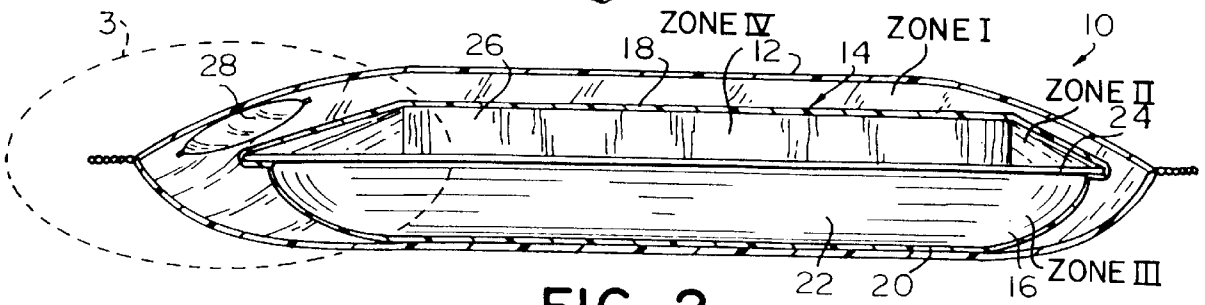
FIG. 2 (PRIOR ART)
FIG. 2 is a section view taken generally along line 2—2 in FIG. 1.
Figure 3:
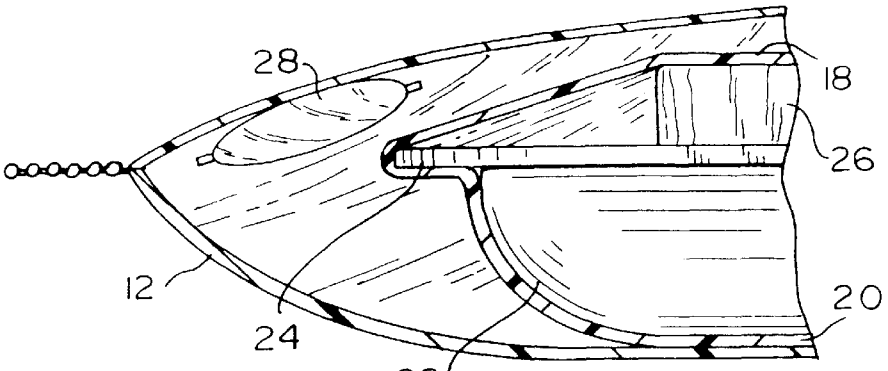
FIG. 3 is an enlarged view taken generally along circled portion 3 in FIG. 2.

Turning now to the drawings, FIGS. 1–3 depict a modified atmosphere package 10 including an outer package 12 and an inner package 14. The term "package" as used herein shall be defined as any means for holding raw meat, including a container, carton, casing, parcel, holder, tray, flat, bag, film envelope, etc. At least a portion of the inner package 14 is permeable to oxygen. The inner package 14 includes a conventional semi-rigid plastic tray 16 thermoformed from a sheet of polymeric material which is substantially permeable to oxygen. Exemplary polymers which may be used to form the non-barrier tray 16 include polystyrene foam, cellulose pulp, polyethylene, polypropylene, etc. In a preferred embodiment, the polymeric sheet used to form the tray 16 is substantially composed of polystyrene foam and has a thickness ranging from about 100 mils to about 300 mils. The use of a common polystyrene foam tray 16 is desirable because it has a high consumer acceptance. The inner package 14 further includes a stretch film wrapping or cover 18 substantially composed of a polymeric material, such as polyvinyl chloride (PVC), which is substantially permeable to oxygen. Like a foam tray, a PVC stretch film wrapping has a high consumer acceptance. In a preferred embodiment, the stretch film used to form the cover 18 contains additives which allow the film to cling to itself, has a thickness ranging from about 0.5 mil to about 1.5 mils, and has a rate of oxygen permeability greater than about 1000 cubic centimeters per 100 square inches in 24 hours. Preferably, the film has a rate of oxygen permeability greater than about 7,000 cubic centimeters per 100 square inches in 24 hours and, most preferably, has a rate of oxygen permeability greater than about 10,000 cubic centimeters per 100 square inches in 24 hours. One preferred stretch film is Resinite™ meat film commercially available from Borden Packaging and Industrial Products of North Andover, Mass.

The tray 16 is generally rectangular in configuration and includes a bottom wall 20, a continuous side wall 22, and a continuous rim or flange 24. The continuous side wall 22 encompasses the bottom wall 20 and extends upwardly and outwardly from the bottom wall 20. The continuous rim 24 encompasses an upper edge of the continuous side wall 22 and projects laterally outwardly therefrom. A food item such as a retail cut of raw meat 26 is located in a rectangular compartment defined by the bottom wall 20 and continuous side wall 22. The raw meat may be any animal protein, including beef, pork, veal, lamb, chicken, turkey, venison, fish, etc. Prior to fully wrapping the tray 16 with the cover 18, the partially formed inner package 14 may be flushed with an appropriate mixture of gases, typically a mixture of about 30 percent carbon dioxide and about 70 percent nitrogen, to lower the oxygen level in the inner package 14 to about 1.5 to 5.0 percent. The foregoing mixture of gases displaces the oxygen within the inner package 14 during the flushing operation. After flushing the inner package 14, the tray 16 is manually or automatically wrapped with the cover 18. The cover 18 is wrapped over the retail cut of raw meat 26 and about both the side wall 22 and bottom wall 20 of the tray 16. The free ends of the cover 18 are overlapped along the underside of the bottom wall 20 of the tray 16, and, due to the cling characteristic inherent in the cover 18, these overlapping free ends cling to one another to hold the cover 18 in place. If desired, the overwrapped tray 16, i.e., the inner package 14, may be run over a hot plate to thermally fuse the free ends of the cover 18 to one another and thereby prevent these free ends from potentially unraveling.

The outer package 12 is preferably a flexible polymeric bag composed of a single or multilayer plastics material which is substantially impermeable to oxygen. The polymeric bag 12 may, for example, include a multilayer coextruded film containing ethylene vinyl chloride (EVOH), or include an oriented polypropylene (OPP) core coated with an oxygen barrier coating such as polyvinylidene chloride and further laminated with a layer of sealant material such as polyethylene to facilitate heat sealing. In a preferred embodiment, the polymeric bag 12 is composed of a coextruded barrier film commercially available as product no. 325C44-EX861B from PrintPack, Inc. of Atlanta, Ga. The coextruded barrier film has a thickness ranging from about 2 mils to about 6 mils, and has a rate of oxygen permeability less than about 0.1 cubic centimeters per 100 square inches in 24 hours. Prior to sealing the peripheral edges of the polymeric bag 12, the inner package 14 is placed within the polymeric bag 12. Also, the bag 12 is flushed with an appropriate mixture of gases, typically about 30 percent carbon dioxide and about 70 percent nitrogen, to lower the oxygen level in the bag 12 to about 0.05 to 5.0 percent. After flushing the bag 12, but still prior to sealing the bag 12, an oxygen scavenger/absorber 28 is placed in the bag 12 external to the sealed inner package 14. The bag 12 is then sealed.

The oxygen scavenger 28 is designed to reduce the oxygen level in the bag 12 at a rate sufficient to prevent discoloration (e.g., browning) of the raw meat 26. Many factors influence the color stability of raw meat, but it has been found that the reduction of the oxygen level from the 0.05 to 5.0 percent level described about to less than about 0.05 percent within 90 minutes works for all types of raw meat. If there is still oxygen in the bag 12 after this time period, the oxygen scavenger 28 absorbs any remaining oxygen in the bag 12 and any oxygen which might still be trapped within the inner container 14 so as to lower the oxygen level in the bag 12 to about zero percent within 24 hours. The oxygen scavenger 28 also absorbs any oxygen which might permeate into the bag 12 from the ambient environment. To increase the rate of oxygen absorption, the oxygen scavenger is activated with an oxygen uptake accelerator in the form of a predetermined amount of activating agent or by other means just prior to being placed in the bag 12. The oxygen uptake accelerator is preferably selected from the group consisting of water or aqueous solutions of acetic acid, citric acid, sodium chloride, calcium chloride, magnesium chloride and copper.

Further information concerning the oxygen scavenger 28, the oxygen uptake accelerator, and the means for introducing the oxygen uptake accelerator to the oxygen scavenger 28 may be obtained from application Ser. No. 08/856,448, filed May 14, 1997, now U.S. Pat. No. 5,928,560, entitled "Oxygen Scavenger Accelerator," and incorporated herein by reference. In FIGS. 1–3, the oxygen scavenger 28 is illustrated as a packet or label which is inserted into the bag 12 prior to sealing the bag 12. Alternatively, an oxygen scavenging material may be added to the polymer or polymers used to form the outer package 12 so that the oxygen scavenging material is integrated into the outer package 12 itself.

The retail cut of raw meat 26 within the modified atmosphere package 10 takes on a purple-red color when the oxygen is removed from the interior of the package 10. The meat-filled modified atmosphere package 10 may now stored in a refrigeration unit for several weeks prior to being offered for sale at a grocery store. A short time (e.g., less than one hour) prior to being displayed at the grocery store, the inner package 14 is removed from the polymeric bag 12 to allow oxygen from the ambient environment to permeate the non-barrier tray 16 and non-barrier cover 18. The purple-red color of the raw meat 26 quickly changes or "blooms" to a generally acceptable bright red color when the raw meat 26 is oxygenated by exposure to air.

Figure 4:
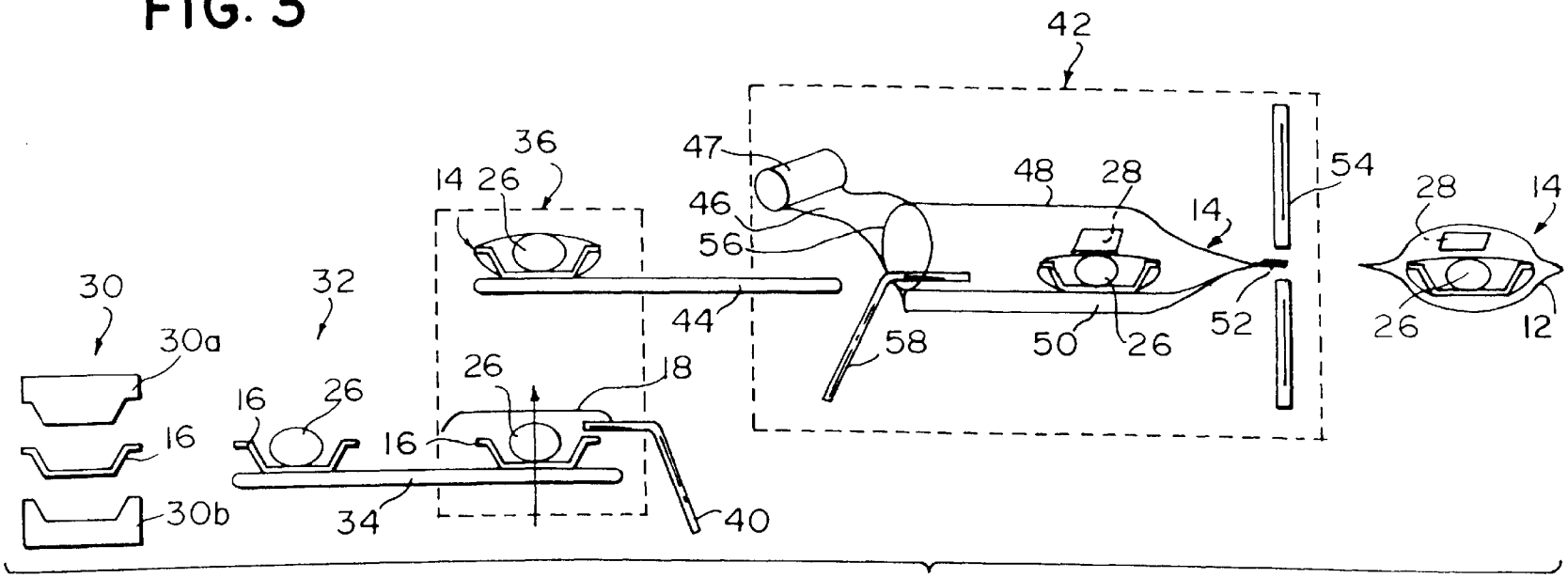
FIG. 4 is a diagrammatic side view of a system for making the modified atmosphere package.
Figure 5B:
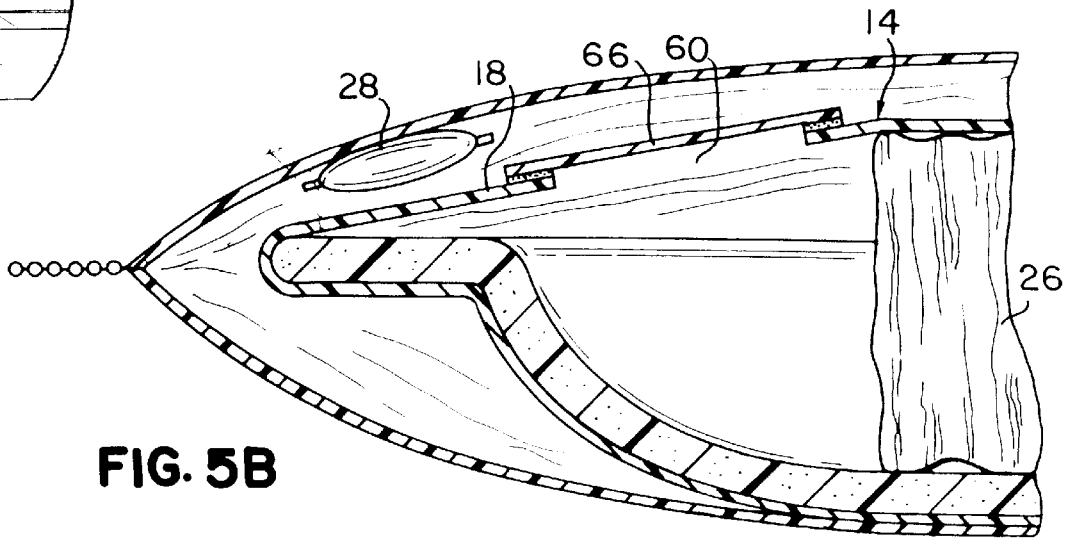
FIG. 5*b* is an enlarged section view taken generally along line 5*b*—5*b* in FIG. 5*a;*
Figure 5A:
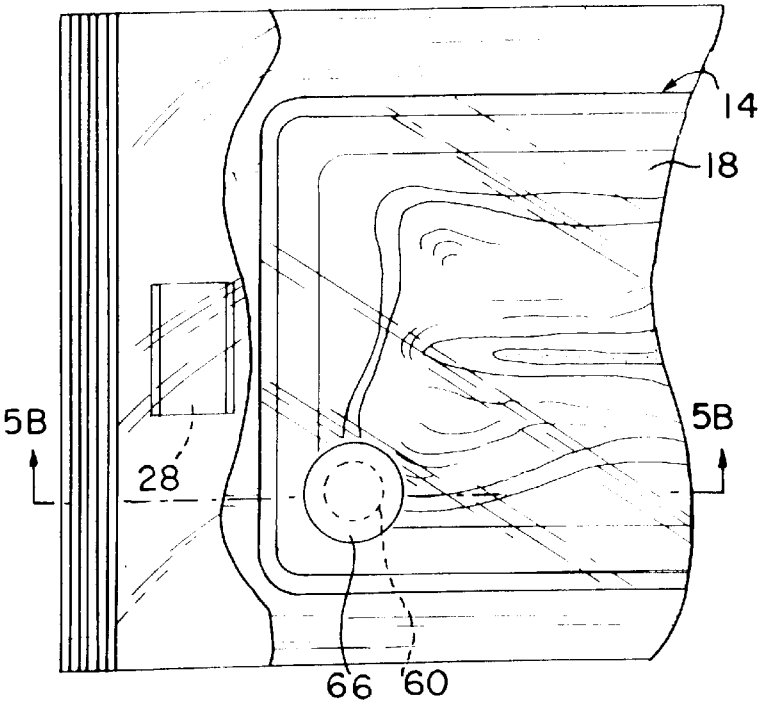
FIG. 5*a* is a top view of a section of the modified atmosphere package with a portion of the outer package broken away to reveal an inner package having stretch film wrapping with a hole covered by a TYVEK patch.

FIG. 4 illustrates a modified atmosphere packaging system used to produce the modified atmosphere package 10 in FIGS. 1–3. The packaging system integrates several disparate and commercially available technologies to provide a modified atmosphere for retail cuts of raw meat. The basic operations performed by the packaging system are described below in connection with FIG. 4.

The packaging process begins at a thermoforming station 30 where a tray 16 is thermoformed in conventional fashion from a sheet of polystyrene or other non-barrier polymer using conventional thermoforming equipment. The thermoforming equipment typically includes a male die member 30*a* and a female die cavity 30*b*. As is well known in the thermoforming art, the tray 16 is thermoformed by inserting the male die member 30*a* into the female die cavity 30*b* with the polymeric sheet disposed therebetween.

The thermoformed tray 16 proceeds to a goods loading station 32 where the tray 16 is filled with a food product such as a retail cut of raw meat 26. The meat-filled tray 16 is then manually carried or transported on a conveyor 34 to a conventional stretch wrapping station 36 where a stretch film 18 is wrapped about the tray 16 to enclose the retail cut of meat 26 therein. The overwrapped tray 16 forms the inner package 14. Just prior to sealing the meat-filled tray 16 at the stretch wrapping station 36, the tray 16 is flushed with a mixture of carbon dioxide and nitrogen to reduce the oxygen level in the tray 16 to about 1.5 to 5.0 percent. The mixture of carbon dioxide and nitrogen emanates from a conventional gas supply hollow tube or rod 40 fed by a gas tank (not shown). The stretch wrapping station 36 may be implemented with a compact stretch semi-automatic wrapper commercially available from Hobart Corporation of Troy, Ohio.

Next, the flushed and sealed inner package 14 proceeds to a high speed form, fill, and seal station 42 which may be implemented with a Fuji-Formost high-speed horizontal form-fill-seal machine commercially available as model no. FW-3700 from Formost Packaging Machines, Inc. of Woodinville, Wash. The inner package 14 may be transported to the form, fill, and seal station 42 by a conveyor 44. At the form, fill, and seal station 42, a web 46 of oxygen barrier film from a roll 47 is arranged to run along the direction of movement of the inner package 14. The web 46 of film is fed to a conventional forming box which forms a section 48 of the web 46 into a tube configuration encompassing the inner package 14. The tube-shaped section 48 of the web 46 is thermally sealed along a lower fin 50 and is thermally sealed at one end 52 by a pair of vertically-oscillating heated sealing bars 54 or the like.

Just prior to sealing the other end 56 of the tube-shaped web section 48 to complete formation of the polymeric bag 12, the web section 48 is flushed with an appropriate mixture of gases, typically about 30 percent carbon dioxide and about 70 percent nitrogen, to lower the oxygen level in the bag 12 to about 0.05 to 5.0 percent. The mixture of carbon dioxide and nitrogen emanates from a conventional gas supply hollow tube or rod 58 fed by a gas tank (not shown). After flushing the web section 48, but still prior to sealing the end 56, the oxygen scavenger/absorber 28 is placed in the web section 48 external to the sealed inner container 14 and the oxygen scavenger 28 is activated with an oxygen uptake accelerator. The end 56 is then conveyed between and sealed by the heated sealing bars 54 to complete formation of the bag 12. In addition to thermally fusing the web section 48 at the end 56, the heated sealing bars 54 sever the web section 48 at the end 56 to separate the bag 12 from the next upstream web section being formed into another bag. The sealed bag 12 is substantially in the form of a sealed bubble or envelope loosely containing the inner package 14 and providing a sealed modified atmosphere surrounding the inner package 14.

The oxygen scavenger 28 lowers the oxygen level in the package 10 from the previously described 0.05 to 5.0 percent oxygen level to less than about 0.05 percent within a time period of about 90 minutes. Although the oxygen scavenger 28 is depicted in FIG. 4 as a packet or label inserted into the polymeric bag 12, an oxygen scavenger may alternatively be integrated into the polymers used to form the bag 12. One preferred oxygen scavenger is a FreshPax™ oxygen absorbing packet commercially available from MultiSorb Technologies, Inc. (formerly Multiform Desiccants Inc.) of Buffalo, N.Y.

The modified atmosphere packaging system in FIG. 4 can produce the modified atmosphere packages 10 at cycle rates ranging from about 1 to 60 packages per minute. The maximum cycle rates which can be attained by the system in FIG. 4 are significantly higher than the cycle rates which can be achieved by prior art systems. The attainment of high cycle rates is largely due to the fact that the packaging system in FIG. 4 relies upon the use of simple, commercially available, and high-speed form, fill, and seal equipment, as opposed to the slower evacuation equipment employed by prior art systems. Reducing oxygen levels in the modified atmosphere package 10 by first flushing the package 10 and then subsequently introducing the activated oxygen scavenger 28 into the package 10 is significantly faster and more cost-effective than the reliance upon slow evacuation techniques.

Referring to FIG. 2, the region outside the inner package 14 and inside the outer package 12 defines a first compartment or zone I, while the region inside the inner package 14 defines a second compartment or zone II. The inner package 14 itself forms a partition member between the first and second compartments. As discussed above, after the outer package 12 is sealed during the manufacturing process, it is desirable to improve the flow of oxygen from the second compartment to the first compartment so that any oxygen in the second compartment can be rapidly absorbed by the activated oxygen scavenger 28 in the first compartment. The improved flow of oxygen, in turn, minimizes the amount of time that the meat in the second compartment is exposed to oxygen levels in the pigment sensitive range (0.05 to 2 percent). Minimizing the exposure of the meat to oxygen levels in the pigment sensitive range inhibits the formation of metmyoglobin, which can cause the meat to change to an undesirable brown color.

The present invention provides various features that can be incorporated in the inner package 14 to increase its oxygen permeability to rates in excess of about 7,000 cubic centimeters per 100 square inches in 24 hours and, most preferably, to rates in excess of about 10,000 cubic centimeters per 100 square inches in 24 hours. Such high rates of oxygen permeability allow the activated oxygen scavenger 28 in the first compartment to lower the oxygen level in the second compartment (inner package 14) to less than about 0.05 percent within a time period of less than about two hours and typically about 90 minutes after the package 10 is sealed. The permeability-increasing features can be employed separately or in combination. In addition to increasing the oxygen permeability of the inner package 14, the present invention addresses other concerns such as preventing meat juices (purge) from escaping the inner package 14, preventing desiccation of the meat, and preventing bacterial contamination of the meat. Leakage of juices from the inner package is a significant drawback of the system proposed by U.S. Pat. No. 5,667,827 to Breen et al.

Figure 6A:
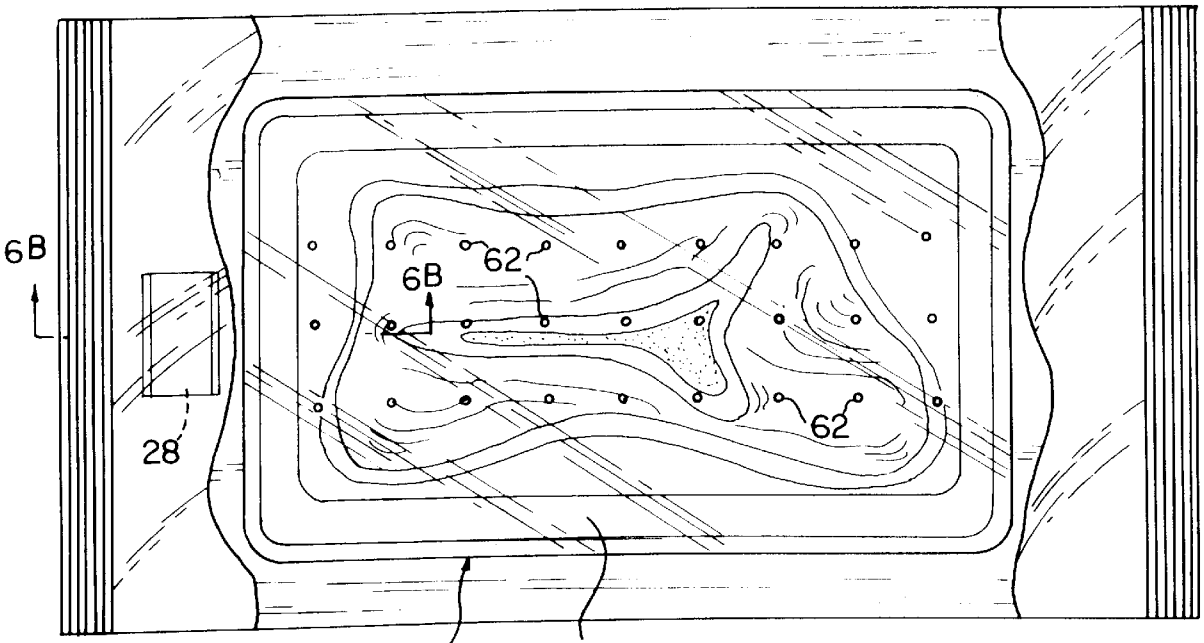
FIG. 6*a* is a top view of the modified atmosphere package with a portion of outer package broken away to reveal an inner package having perforated stretch film wrapping.
Figure 6B:
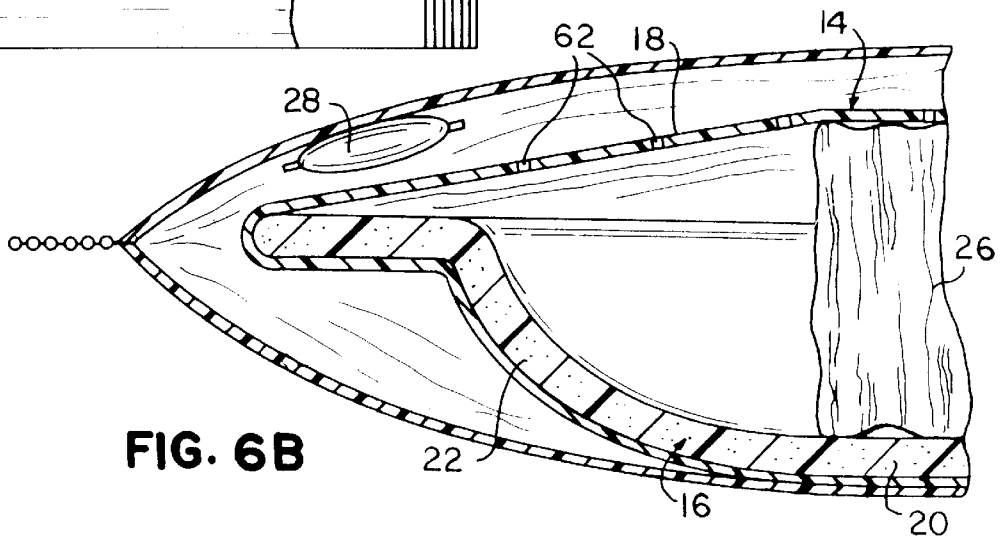
FIG. 6*b* is an enlarged section view taken generally along line 6*b*—6*b* in FIG. 6*a;*

Referring to FIGS. 5*a–b*, 6*a–b*, and 7*a–b*, if the inner package 14 is partially comprised of a stretch film wrapping 18 such as polyvinyl chloride (PVC), the stretch film wrapping 18 can be provided with one or more relatively large holes 60 (FIGS. 5*a–b* and 7*a–b*) or a plurality of pin holes or microperforations 62 (FIGS. 6*a–b*). The holes 62 in FIG. 6*a* can represent either pin holes or microperforations. In order for the holes to be effective, they must communicate with the interior of the package 14. Accordingly, the holes should be located along the portion of the stretch film wrapping 18 generally above the tray bottom wall 20 and inside the continuous tray side wall 22. The holes may be made during the manufacture of the stretch film wrapping 18 or just prior to covering the tray 16 with the wrapping 18.

If the holes are relatively large holes 60 as in FIGS. 5*a–b* and 7*a–b*, e.g., having a diameter ranging from about 0.125 inch to about 0.75 inch, the holes are preferably covered with a patch or label 66 composed of TYVEK® spunbonded olefin, paper, or plastic to prevent meat juice from leaking out of the second compartment through the holes and to prevent desiccation and contamination of the meat. TYVEK spunbonded olefin is commercially available from DuPont of Wilmington, Del. The holes are punched in the stretch film wrapping 18 before the label 66 is applied. The label 66 could be decorative or could provide pricing information. Using a food-grade adhesive, the label 66 is adhered to the stretch film wrapping 18 in areas around the holes. In one embodiment best shown in FIG. 5*b*, the label 66 is circular, has an outer diameter of 0.75 inch, and has adhesive applied to an area bound by the outer diameter of 0.75 inch and an inner diameter of about 0.375 to 0.5 inch. The area within the inner diameter is free of adhesive. With respect to a TYVEK label (FIGS. 5*a–b*), since TYVEK spunbonded olefin is entirely permeable to oxygen, no additional holes are formed in the TYVEK label. When attaching the TYVEK label to the stretch film wrapping, the food-grade adhesive is not applied to the portion of the label covering the holes so that the oxygen permeable pores in the label are not plugged by the adhesive. With respect to a paper or plastic label (FIGS. 7*a–b*), which is somewhat impermeable to oxygen, additional pin holes or microperforations 70 (FIG. 7*b*) are formed in the label. Although a label 66 over the relatively large holes in the stretch film wrapping 18 is preferred, the label is not absolutely necessary so long as care is taken to avoid tilting the package 10 to a degree that allows meat juices to leak out of the inner package 14.

Figure 6C:
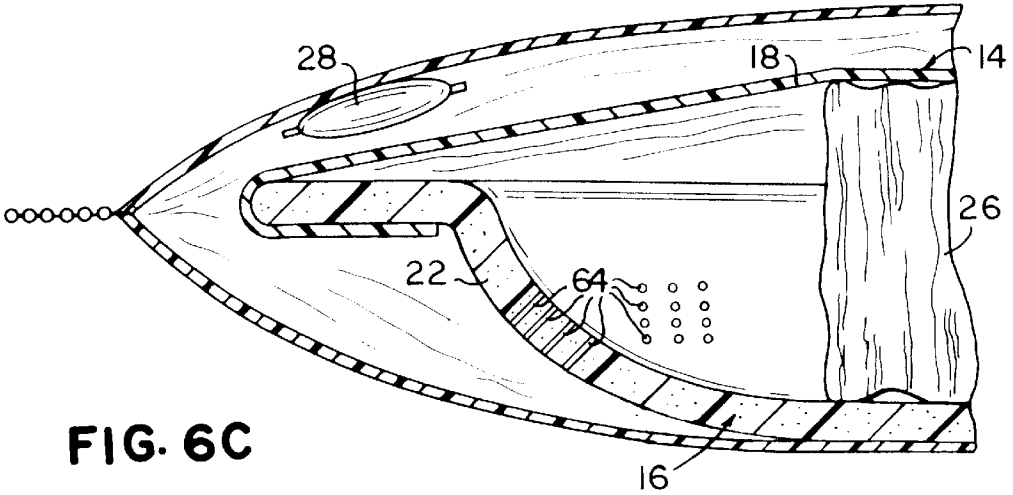
FIG. 6*c* is an enlarged view similar to FIG. 3 but showing pin holes formed in a tray wall.
Figure 8:
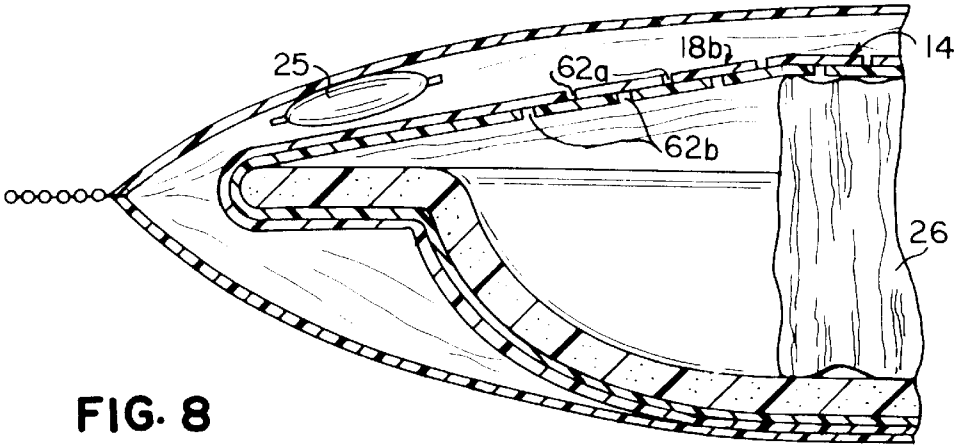
FIG. 8 is an enlarged view similar to FIG. 3 but showing an inner package having stretch film wrapping comprised of two layers of perforated film.

If, on the other hand, the holes are pin holes or microperforations 62 (FIG. 6*a*) having a diameter ranging from about 0.004 inch to about 0.030 inch, a label is not preferred because the holes are sufficiently small in diameter that surface tension prevents meat juice from passing through the holes. In the illustrated embodiment, the small holes 62 are applied to most of the portion of the wrapping 18 located inside the tray side wall 22 and are arranged in a rectangular grid. Adjacent ones of the holes are spaced approximately one inch from each other. Alternatively, as shown in FIG. 6*c*, pin holes 64 can be formed in an unwrapped section of the side wall 22 of the tray 16. As shown in FIG. 8, if larger perforations are desired, the stretch film wrapping 18*b* may be comprised of two perforated layers in which the perforations 62*a* of one layer are offset from (not aligned with) the perforations 62*b* of the other layer. The offset perforations create a tortuous path that prevents leakage of meat juices from the inner package 14.

Experiments have found that all of the above options concerning the application of holes and labels to the stretch film wrapping 18 successfully increase the oxygen permeability of the inner package 14 to rates that allow the activated oxygen scavenger 28 in the first compartment to lower the oxygen level in the second compartment (inner package 14) to less than about 0.05 percent within a time period of less than about two hours after the package 10 is sealed. Specifically, the experiments tested the following options: one hole having a diameter of 0.125 inch, one 0.25 inch hole, one 0.375 inch hole, four 0.125 inch holes with TYVEK label, one 0.25 inch hole with TYVEK label, one 0.375 inch hole with TYVEK label, one 0.75 inch hole with TYVEK label, one 0.75 inch hole with paper label having 15 pin holes, one 0.75 inch hole with paper label having 12 pin holes, 6 pin holes, 12 pin holes, and microperforations throughout the stretch film wrapping. Each of the above options helped the stretch film wrapping attain acceptable high rates of oxygen permeability.

Figure 10:
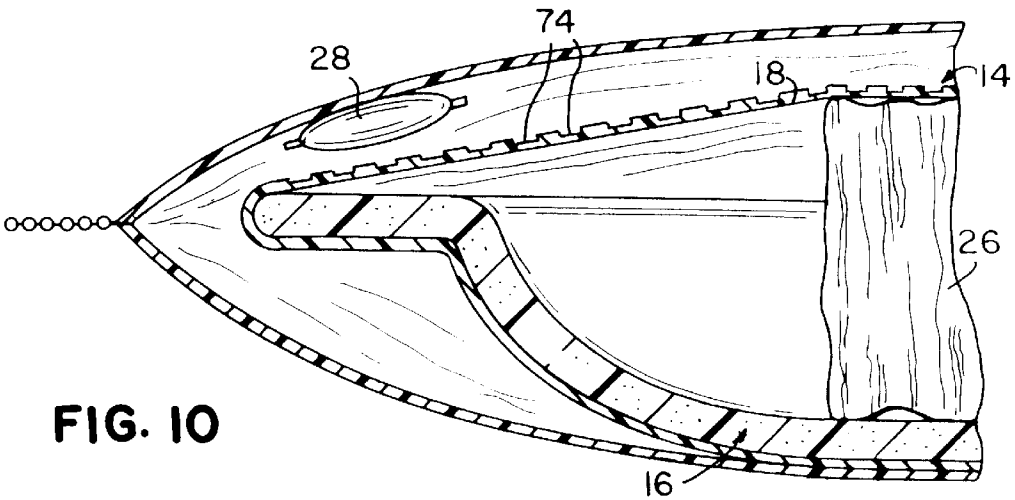
FIG. 10 is an enlarged view similar to FIG. 3 but showing an inner package having an embossed stretch film wrapping.
Figure 7A:
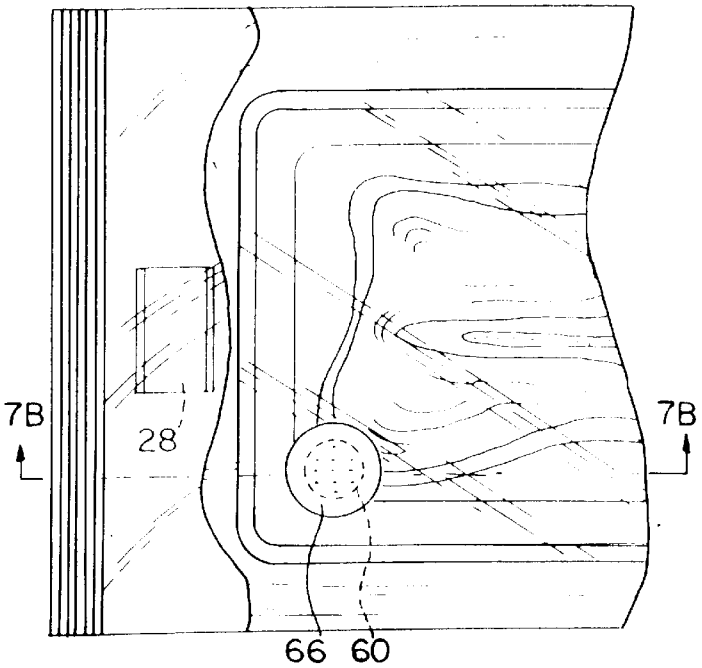
FIG. 7*a* is a top view of a section of the modified atmosphere package with a portion of the outer package broken away to reveal an inner package having stretch film wrapping with a hole covered by a perforated paper or plastic patch.
Figure 7B:
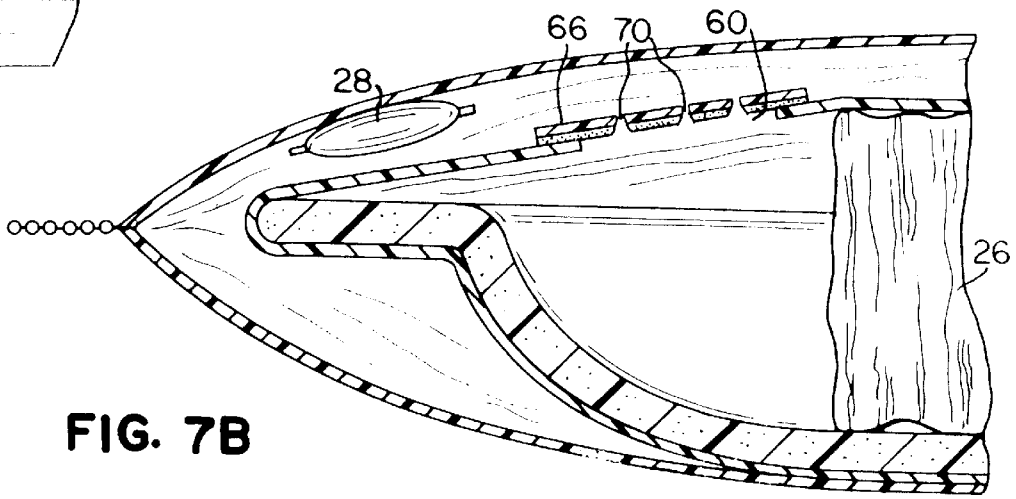
FIG. 7*b* is an enlarged section view taken generally along line 7*b*—7*b* in FIG. 7*a;*
Figure 9:
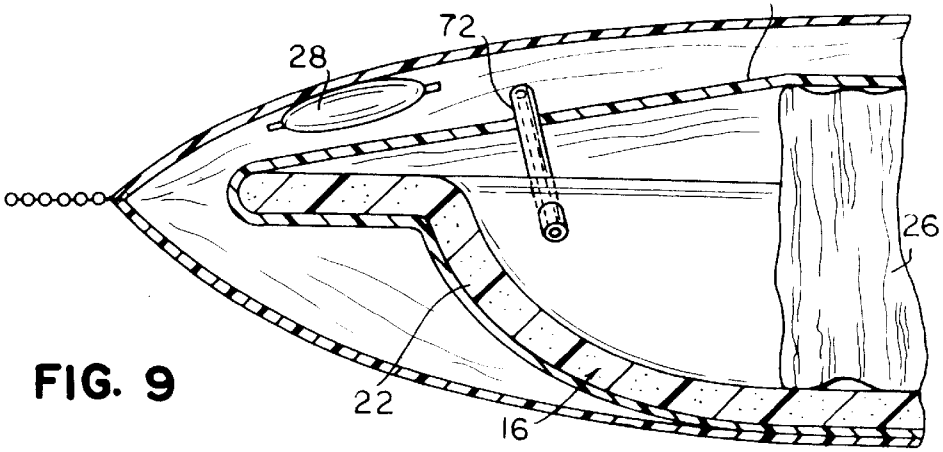
FIG. 9 is an enlarged view similar to FIG. 3 but showing a straw mounted to the inner package of the modified atmosphere package.
Figure 11A:
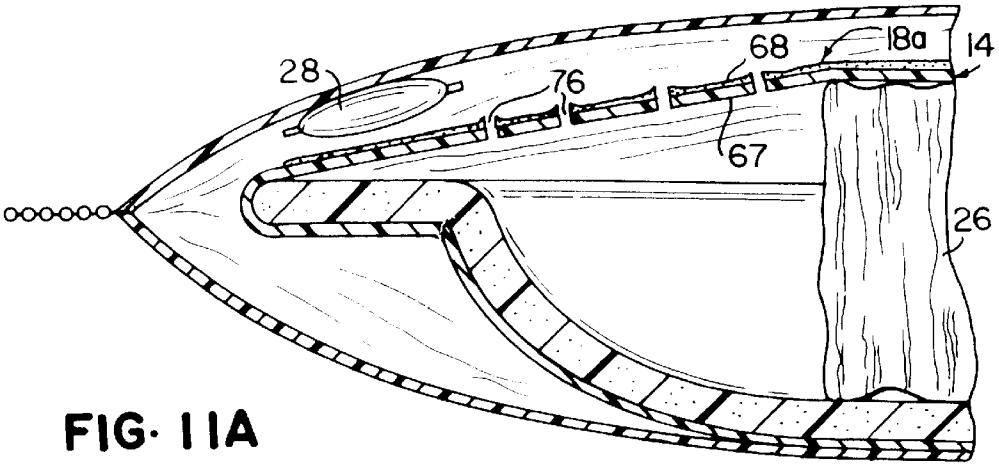
FIG. 11*a* is an enlarged side view similar to FIG. 3 but showing holes punched through an inner package wrapping comprised of standard stretch film coated with a self-sealing layer of low molecular weight wax or polymer.
Figure 11B:
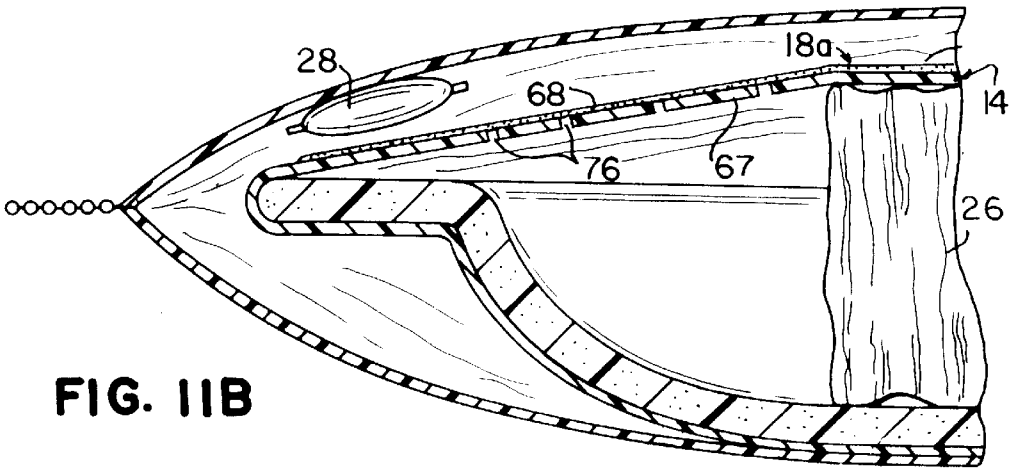
FIG. 11*b* is an enlarged side view similar to FIG. 11*a* but showing the holes plugged by the self-sealing layer.

Various other features can be incorporated in the partition member to increase its permeability. FIG. 9 depicts a snorkel or straw 72 inserted through the stretch film wrapping 18 and the side wall 22 of the tray 16 and into the interior of the tray. FIG. 10 depicts embossments 74 formed in the stretch film wrapping 18. The embossed areas of the stretch film wrapping are thinner than other areas of the stretch film wrapping and, therefore, exhibit higher oxygen permeability rates. FIGS. 11*a* and 11*b* depict a stretch film wrapping 18*a* including a PVC layer 67 and a thin self-sealing layer 68 of food-grade wax or polymer having a low molecular weight. The self-sealing layer 68 can be applied to the PVC layer 67 by conventional spraying techniques or by conventional application and metering rollers of a printing press. Since the layer 68 is self-sealing, holes 76 formed in the wrapping 18*a* are only temporary and are plugged by the self-sealing layer 68 over time (FIG. 11*b*). The holes 76 are formed in the wrapping 18*a* during the manufacturing process prior to sealing the package 10 and are exposed long enough to allow the oxygen scavenger 28 to lower the oxygen level in the inner package 14 to less than about 0.05 percent in less than about two hours after the package 10 is sealed. As shown in FIG. 11*b*, the holes 76 are preferably plugged prior to shipping the meat-filled package 10 to eliminate the possibility of leakage of meat juices from the inner package 14.

Figure 15:
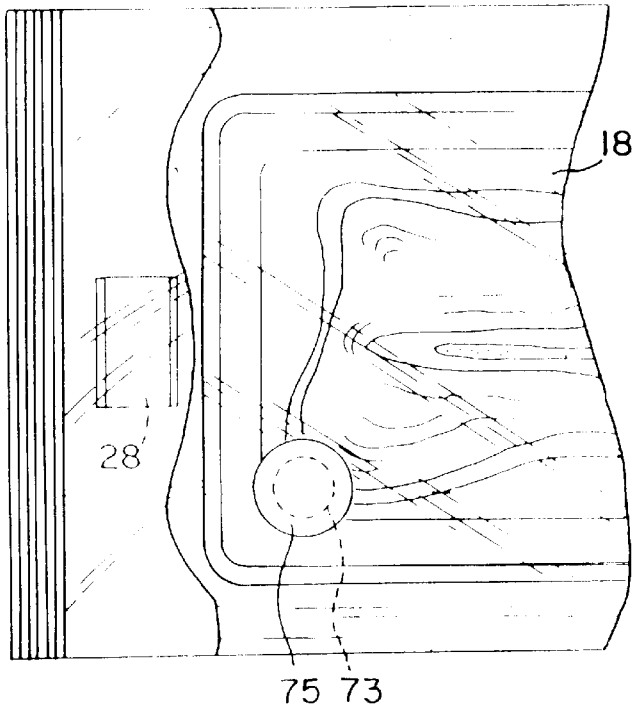
FIG. 15 is a top view of a section of the modified atmosphere package with a portion of outer package broken away to reveal an inner package having stretch film wrapping with a hole covered by a Landec-type film patch.

In another embodiment, the stretch film wrapping 18 in FIGS. 1–3 is composed of a Landec-type film, produced by the so-called Intellimer process, having a permeability that can be controlled by heat, light, or some other energy source. The film is normally in a substantially impermeable amorphous state and can be temporarily switched to a highly permeable crystalline state by application of the energy source. The energy source is applied to the Landec-type film during the manufacturing process and for a long enough time period after the package 10 is sealed to allow the oxygen scavenger 28 to lower the oxygen level in the second compartment (inner package 14) to less than about 0.05 percent in less than about two hours. Alternatively, as depicted in FIG. 15, the stretch film wrapping 18 can be composed of conventional polyvinyl chloride and include a hole 73 covered by a label 75 composed of a Landec-type film.

Figure 12:
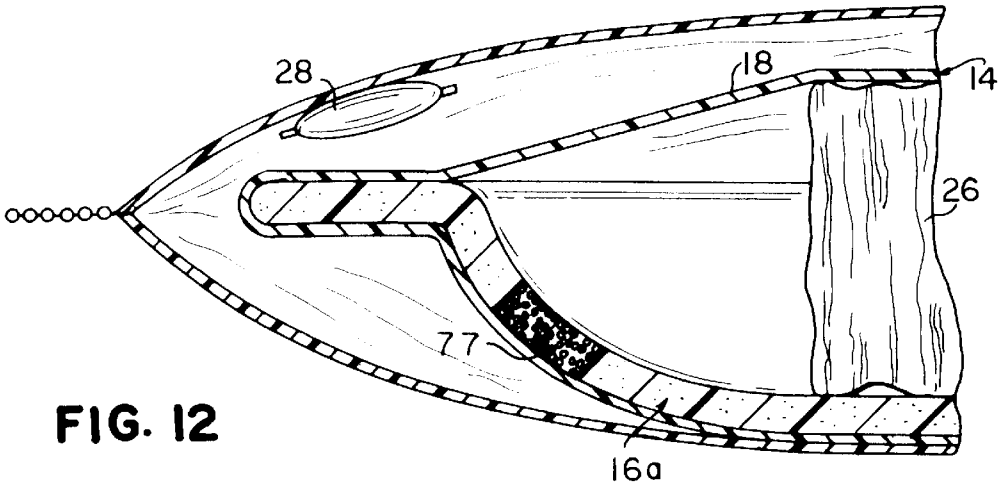
FIG. 12 is an enlarged side view similar to FIG. 3 but showing an unwrapped section of the tray wall formed from open cell or perforated foam.

In yet another embodiment depicted in FIG. 12, the inner package 14 includes a stretch film wrapping 18 wrapped partially about a foam tray 16*a* having an exposed (unwrapped) section 77 composed of open-cell or perforated polystyrene foam. The open-cell or perforated foam section 77 of the tray 16*a* is highly permeable to oxygen and helps the inner package 14 to attain a higher rate of oxygen permeability than an inner package composed entirely of a close-cell foam. To take advantage of the highly permeable open-cell or perforated foam section 77 of the tray 16*a*, the coverage of the stretch film wrapping 18 on the tray bottom is partial to allow oxygen from the inner package 14 to pass through the open-cell or perforated foam section.

Figure 13:
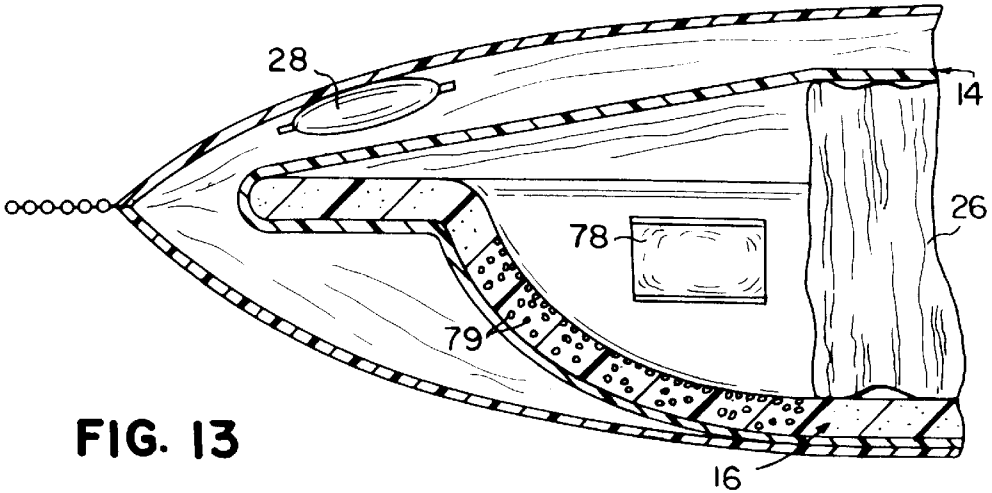
FIG. 13 is an enlarged side view similar to FIG. 3 but showing an oxygen scavenging packet affixed to the tray wall and oxygen scavenging material dispersed within the tray wall.

Other possible techniques for rapidly reducing the oxygen level in the second compartment (inner package 14) pertain less to altering the structure of the tray 16 or the stretch film wrapping 18. For example, as shown in FIG. 13, a second oxygen scavenger 78 can be placed inside the inner package 14 away from the meat 26. Alternatively or in addition, oxygen scavenging material 79 can be dispersed in the wall of the tray 16. Like the oxygen scavenger 28, the oxygen scavenger 78 is preferably activated with an oxygen scavenger accelerator just prior to sealing the inner package 14 during the manufacturing process. To keep the oxygen scavenger 78 separated from the meat 26, the oxygen scavenger 78 can be adhered by a food-grade adhesive to one side of the tray 16 or can be housed in a highly permeable enclosure along one side of the tray 16. The oxygen scavenger 78 directly absorbs any oxygen present in the second compartment (inner package 14) and does not require the oxygen to pass from the second compartment to the first compartment in order to be absorbed.

Figure 14:
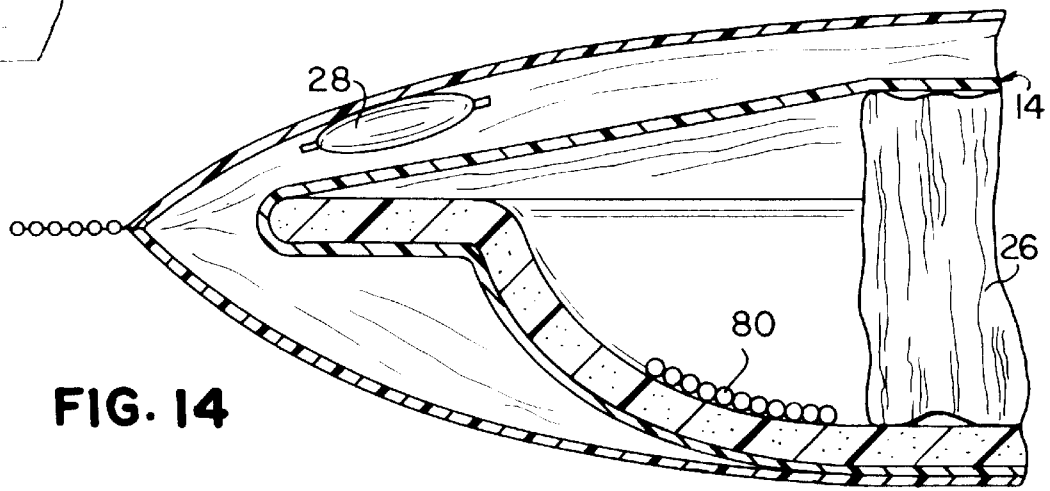
FIG. 14 is an enlarged side view similar to FIG. 3 but showing carbon dioxide pellets along the tray wall.

Alternatively, as shown in FIG. 14, carbon dioxide pellets 80 (dry ice) can be placed inside the inner package 14 away from the meat 26. The pellets 80 serve as a flushing agent that forces oxygen out of the inner package 14 even after the package 10 is sealed. In yet another embodiment, the sealed package 10 is irradiated to create ozone ($O_3$) within the package 10. Ozone is more readily scavenged than oxygen ($O_2$) by the oxygen scavenger 28, and therefore oxygen levels within the second compartment (inner package 14) holding the meat 26 are reduced more rapidly. In effect, the carbon dioxide pellets 80 and the creation of ozone each increase the rate of oxygen egress from the second compartment (inner package 14) to the first compartment.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims

What is claimed is:

1. A modified atmosphere package comprising first and second compartments separated by a partition member substantially permeable to oxygen, said first compartment containing a first oxygen scavenger activated with an oxygen scavenger accelerator, said second compartment containing a retail cut of raw meat, and further including additional oxygen scavenging means, located outside said first compartment, for absorbing oxygen within said second compartment.

2. The package of claim 1, wherein said additional oxygen scavenging means includes a second oxygen scavenger contained in said second compartment and separated from said raw meat.

3. The package of claim 2, wherein said partition member includes a tray having a tray wall, and wherein said second oxygen scavenger is affixed to said tray wall.

4. The package of claim 1, wherein said partition member includes a tray having a tray wall, and wherein said additional oxygen scavenging means includes oxygen scavenging material dispersed within said tray wall.

* * * * *